US009027972B2

(12) United States Patent
Muramatsu et al.

(10) Patent No.: US 9,027,972 B2
(45) Date of Patent: May 12, 2015

(54) RETAINING DEVICE FOR VEHICLE DOOR

(75) Inventors: Akira Muramatsu, Chiryu (JP); Kosuke Tsukamoto, Chiryu (JP); Kimito Shimizu, Anjo (JP); Kenji Oriishi, Kariya (JP); Yoshiki Odaka, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 24 days.

(21) Appl. No.: 13/580,609

(22) PCT Filed: Feb. 21, 2011

(86) PCT No.: PCT/JP2011/053680

§ 371 (c)(1),
(2), (4) Date: Aug. 22, 2012

(87) PCT Pub. No.: WO2011/105328

PCT Pub. Date: Sep. 1, 2011

(65) Prior Publication Data

US 2012/0311819 A1 Dec. 13, 2012

(30) Foreign Application Priority Data

Feb. 26, 2010 (JP) ..... 2010-042436
Aug. 30, 2010 (JP) ..... 2010-192050

(51) Int. Cl.
*E05C 17/44* (2006.01)
*E05B 85/04* (2014.01)

(52) U.S. Cl.
CPC ..... *E05B 85/045* (2013.01); *Y10S 292/03* (2013.01); *Y10S 292/55* (2013.01)

(58) Field of Classification Search
USPC ..... 292/DIG. 38, DIG. 39, DIG. 19, DIG. 51, 292/DIG. 55, 342, 343, 216
See application file for complete search history.

(56) References Cited

U.S. PATENT DOCUMENTS 1,500,562 A * 7/1924 Hopf ..... 292/342
2,024,887 A * 12/1935 Schonitzer ..... 16/85

(Continued)

FOREIGN PATENT DOCUMENTS

| | | | |
|---|---|---|---|
| JP | 1-43298 | Y2 | 12/1989 |
| JP | 9-13754 | A | 1/1997 |
| JP | 2003-13640 | A | 1/2003 |
| JP | 2003320851 | A | 11/2003 |
| JP | 2010-174479 | A | 8/2010 |

OTHER PUBLICATIONS

International Search Report (PCT/ISA/210) issued on May 24, 2011, by the Japanese Patent Office as the International Searching Authority for International Application No. PCT/JP2011/053680.

(Continued)

*Primary Examiner* — Kristina Fulton
*Assistant Examiner* — Thomas Neubauer
(74) *Attorney, Agent, or Firm* — Buchanan Ingersoll & Rooney PC

(57) ABSTRACT

A vehicle door locking apparatus is equipped with a movable wedge, a fixed wedge, and an elastic member. The movable wedge is movable in the open/close direction of the vehicle door towards the vehicle body opening. The elastic member impels the movable wedge toward the fixed wedge. A slanted surface on the movable wedge and a slanted surface on the fixed wedge are configured to come into contact when the door is closed. The movable wedge is assembled on the end surface on the vehicle body opening side along with the base plate of a door lock striker that is assembled on the end surface on the vehicle body opening side. The fixed wedge is immovably assembled on the mounting section of the end surface on the vehicle door side, which is involved in a door lock assembly that is assembled on the end surface on the vehicle door side.

9 Claims, 22 Drawing Sheets

(56) References Cited

U.S. PATENT DOCUMENTS

| | | | | |
|---|---|---|---|---|
| 2,100,591 | A * | 11/1937 | Haberstump | 292/302 |
| 6,676,201 | B2 * | 1/2004 | Im et al. | 296/207 |
| 7,232,161 | B2 * | 6/2007 | Matsuda et al. | 292/100 |
| 7,308,731 | B2 * | 12/2007 | Schubring et al. | 16/86 R |
| 8,322,762 | B2 * | 12/2012 | Watson | 292/343 |
| 8,469,440 | B2 * | 6/2013 | Thorpe et al. | 296/146.9 |
| 8,550,508 | B2 * | 10/2013 | Gentile et al. | 292/341.15 |
| 2002/0000727 | A1 * | 1/2002 | Rass et al. | 292/216 |
| 2006/0200939 | A1 * | 9/2006 | Schubring et al. | 16/86 R |
| 2006/0244286 | A1 * | 11/2006 | Meyers et al. | 296/146.1 |
| 2010/0320778 | A1 * | 12/2010 | Stechschulte | 292/216 |

OTHER PUBLICATIONS

Written Opinion (PCT/ISA/237) issued on May 24, 2011, by the Japanese Patent Office as the International Searching Authority for International Application No. PCT/JP2011/053680.

European Supplementary Search Report dated May 28, 2013 issued in the corresponding European Patent Application No. 11747289.4-1603/2540936.

* cited by examiner

RETAINING DEVICE FOR VEHICLE DOOR

TECHNICAL FIELD

The present invention relates to a retaining device for a vehicle door (opening/closing door), and more particularly, to a retaining device for a vehicle door, including a movable wedge which is adapted to be assembled to one of an end surface on a vehicle body opening side and an end surface on the vehicle door side, which come close to each other when the door is closed, and is movable by a predetermined amount in an entering/retracting direction (opening/closing direction) of the vehicle door toward the vehicle body opening, a stationary wedge which is unmovable and adapted to be assembled (or provided) to another of the end surface on the vehicle body opening side and the end surface on the vehicle door side, which come close to each other when the door is closed, and an elastic member for biasing the movable wedge toward the stationary wedge, in which an inclined surface formed in the movable wedge and an inclined surface formed in the stationary wedge are abuttable against each other when the door is closed.

BACKGROUND ART

This type of retaining device for a vehicle door is disclosed in, for example, the following Patent Document 1. In the following Patent Document 1, the movable wedge (described as wedge) and the stationary wedge (described as striker) are provided separately from a vehicle door lock device (in the following Patent Document 1, illustration and description are omitted). Note that, the vehicle door lock device generally includes a door lock striker to be assembled to an end surface on a vehicle body opening side, and a door lock assembly to be assembled to an end surface on a vehicle door side (the door lock assembly including a latch engageable/disengageable with respect to the door lock striker). When the latch is held in an engaged state with the door lock striker, an opening part (vehicle body opening) provided in the vehicle body is closed by the vehicle door (door closing state).

PRIOR ART DOCUMENT

Patent Document

Patent Document 1: Japanese Utility Model Examined Publication No. Hei 01-43298

SUMMARY OF THE INVENTION

Technical Problem

In the retaining device for a vehicle door (described as opening/closing member antivibration device for an automobile) described in the above-mentioned Patent Document 1, the movable wedge (described as wedge) and the stationary wedge (described as striker) are provided separately from the vehicle door lock device (in the following Patent Document 1, illustration and description are omitted), and hence the man-hours for assembling the retaining device to the vehicle is necessary in addition to the man-hours for assembling the vehicle door lock device to the vehicle. Therefore, there is a room for improvement in assembly workability. Further, in a vehicle door opening state, the elastic member for biasing the movable wedge in the retracting direction of the vehicle door is exposed to the outside. This leads to a poor physical appearance, and further foreign matters may enter the elastic member.

Solution to Problem

The present invention has been made to solve the above-mentioned problem, and therefore provides a retaining device for a vehicle door, including: a movable wedge which is adapted to be assembled to one of an end surface on a vehicle body opening side and an end surface on the vehicle door side, which come close to each other when the vehicle door is closed, and is movable by a predetermined amount in an entering/retracting direction of the vehicle door toward the vehicle body opening, the movable wedge having an inclined surface; a stationary wedge which is unmovable and adapted to be assembled to another of the end surface on the vehicle body opening side and the end surface on the vehicle door side, which come close to each other when the vehicle door is closed, the stationary wedge having an inclined surface; and an elastic member for biasing the movable wedge toward the stationary wedge, the inclined surface formed in the movable wedge and the inclined surface formed in the stationary wedge being abuttable against each other when the vehicle door is closed, in which the movable wedge (or the stationary wedge) to be assembled to the end surface on the vehicle body opening side is adapted to be assembled to the end surface on the vehicle body opening side together with a base plate of a door lock striker to be assembled to the end surface on the vehicle body opening side, and in which the stationary wedge (or the movable wedge) to be assembled to the end surface on the vehicle door side is adapted to be assembled to a fixing portion of the end surface on the vehicle door side, the fixing portion being provided for a door lock assembly to be assembled to the end surface on the vehicle door side.

Advantageous Effects of Invention

In the retaining device for a vehicle door of the present invention, when the retaining device is assembled to the vehicle, at least the man-hours for assembling the door lock striker of the vehicle door lock device to the end surface on the vehicle body opening side can be efficiently used. Therefore, compared to the case where the retaining device is assembled to the vehicle separately from the vehicle door lock device, the assembly man-hours can be reduced to improve the assembly workability. Further, the retaining device can be set to the vehicle at low cost.

When carrying out the present invention described above, the stationary wedge to be assembled to the end surface on the vehicle door side may be arranged around a door lock striker entering/exiting hole provided in the end surface on the vehicle door side. Further, the stationary wedge to be assembled to the end surface on the vehicle door side may be assembled to the end surface on the vehicle door side together with the door lock assembly to be assembled to the end surface on the vehicle door side. Further, the movable wedge to be assembled to the end surface on the vehicle body opening side may include a slit to be arranged above a surface of the base plate on which a shaft of the door lock striker is provided upright, for allowing movement of the movable wedge relative to the shaft, the movable wedge being slidably supported by the base plate. In those cases, when the retaining device is assembled to the vehicle, the man-hours for assembling the door lock striker to the end surface on the vehicle body opening side and the man-hours for assembling the door lock assembly to the end surface on the vehicle door side can be efficiently used. Therefore, compared to the case where the retaining device is assembled to the vehicle separately from the door lock striker and the door lock assembly, the assembly man-hours can be reduced to improve the assembly workability. Further, the retaining device can be set to the vehicle at low cost.

Further, according to the present invention, there is provided a retaining device for a vehicle door, including: a movable wedge which is adapted to be assembled to one of an end surface on a vehicle body opening side and an end surface on the vehicle door side, which come close to each other when the vehicle door is closed, and is movable by a predetermined amount in an entering/retracting direction of the vehicle door toward the vehicle body opening, the movable wedge having an inclined surface; a stationary wedge which is unmovable and adapted to be provided to another of the end surface on the vehicle body opening side and the end surface on the vehicle door side, which come close to each other when the vehicle door is closed, the stationary wedge having an inclined surface; and an elastic member for biasing the movable wedge toward the stationary wedge, the inclined surface formed in the movable wedge and the inclined surface formed in the stationary wedge being abuttable against each other when the vehicle door is closed, in which the movable wedge to be assembled to the end surface on the vehicle body opening side is adapted to be assembled to the end surface on the vehicle body opening side together with a base plate of a door lock striker to be assembled to the end surface on the vehicle body opening side, and in which the stationary wedge provided to the end surface on the vehicle door side is adapted to be provided integrally in a fixing portion of the end surface on the vehicle door side, to which a door lock assembly including a latch which is engageable/disengageable with respect to the door lock striker is to be assembled. In the present invention, the stationary wedge of the retaining device is integrally provided to the fixing portion of the end surface on the vehicle door side, to which the door lock assembly including a latch engageable/disengageable with respect to the door lock striker is to be assembled. Therefore, the assembly man-hours for the stationary wedge of the retaining device are unnecessary, and hence the assembly workability of the retaining device can be further improved.

Further, according to the present invention, there is provided a retaining device for a vehicle door, including: a movable wedge which is adapted to be assembled to one of an end surface on a vehicle body opening side and an end surface on the vehicle door side, which come close to each other when the vehicle door is closed, and is movable by a predetermined amount in an entering/retracting direction of the vehicle door toward the vehicle body opening, the movable wedge having an inclined surface; a stationary wedge which is unmovable and adapted to be provided to another of the end surface on the vehicle body opening side and the end surface on the vehicle door side, which come close to each other when the vehicle door is closed, the stationary wedge having an inclined surface; and an elastic member for biasing the movable wedge toward the stationary wedge, the inclined surface formed in the movable wedge and the inclined surface formed in the stationary wedge being abuttable against each other when the vehicle door is closed, in which the stationary wedge provided to the end surface on the vehicle body opening side is adapted to be provided integrally in a base plate of a door lock striker to be assembled to the end surface on the vehicle body opening side, and in which the movable wedge to be assembled to the end surface on the vehicle door side is adapted to be assembled to a fixing portion of the end surface on the vehicle door side together with a door lock assembly to be assembled to the end surface on the vehicle door side. In the present invention, the stationary wedge of the retaining device is integrally provided to the base plate of the door lock striker to be assembled to the end surface on the vehicle body opening side. Therefore, the assembly man-hours for the stationary wedge of the retaining device are unnecessary, and hence the assembly workability of the retaining device can be further improved.

Further, when carrying out the present invention described above, the elastic member may be covered with the movable wedge and is not exposed to outside. In this case, even when the vehicle door is in the opened state, the elastic member is not exposed to the outside, which improves the physical appearance of the vehicle. In addition, it is possible to prevent foreign matters from entering the elastic member and protect the elastic member.

Further, when carrying out the present invention described above, the elastic member may also bias the movable wedge toward an end surface on a side to which the movable wedge is to be assembled, and the movable wedge may slidably abut against the end surface on the side to which the movable wedge is to be assembled in the entering/retracting direction of the vehicle door. In this case, when the vehicle door is opened/closed, the unnecessary movement (backlash) of the movable wedge is restricted. Therefore, generation of abnormal noise (rattling) caused by the unnecessary movement of the movable wedge can be suppressed.

Further, when carrying out the present invention described above, the inclined surface of the movable wedge and the inclined surface of the stationary wedge may be each provided with a large number of stepped portions which are engageable with each other. In this case, without setting the inclination angle of each of the inclined surfaces to an angle of friction or lower, the slipping between the inclined surface of the movable wedge and the inclined surface of the stationary wedge can be prevented, and the inclined surfaces can be downsized (formed in a limited space).

Further, when carrying out the present invention described above, the end surface on the vehicle body opening side may be an end surface of an opening part in a front-rear direction, the opening part being provided in a side part of the vehicle body, and the end surface on the vehicle door side may be an end surface of a side door in the front-rear direction, the side door enabling opening/closing of the opening part. In this case, when bending deformation in the right-left direction occurs in the vehicle body at the time of turning of the vehicle and the like, on the extending side of the vehicle body, the movable wedge can move relative to the stationary wedge so as to move the stationary wedge in a vehicle front-rear direction. In this manner, a gap generated between the opening part of the vehicle body and the side door in the vehicle front-rear direction can be closed (filled). Therefore, at the time of turning of the vehicle and the like in which the side on which the movable wedge has moved relative to the stationary wedge is the contraction side of the vehicle body, the deformation of the vehicle body on the contraction side is suppressed by the movable wedge and the stationary wedge. Therefore, with the retaining device for a vehicle door, the rigidity of the vehicle body of the vehicle can be effectively increased.

MODE FOR CARRYING OUT THE INVENTION

Figure 1:
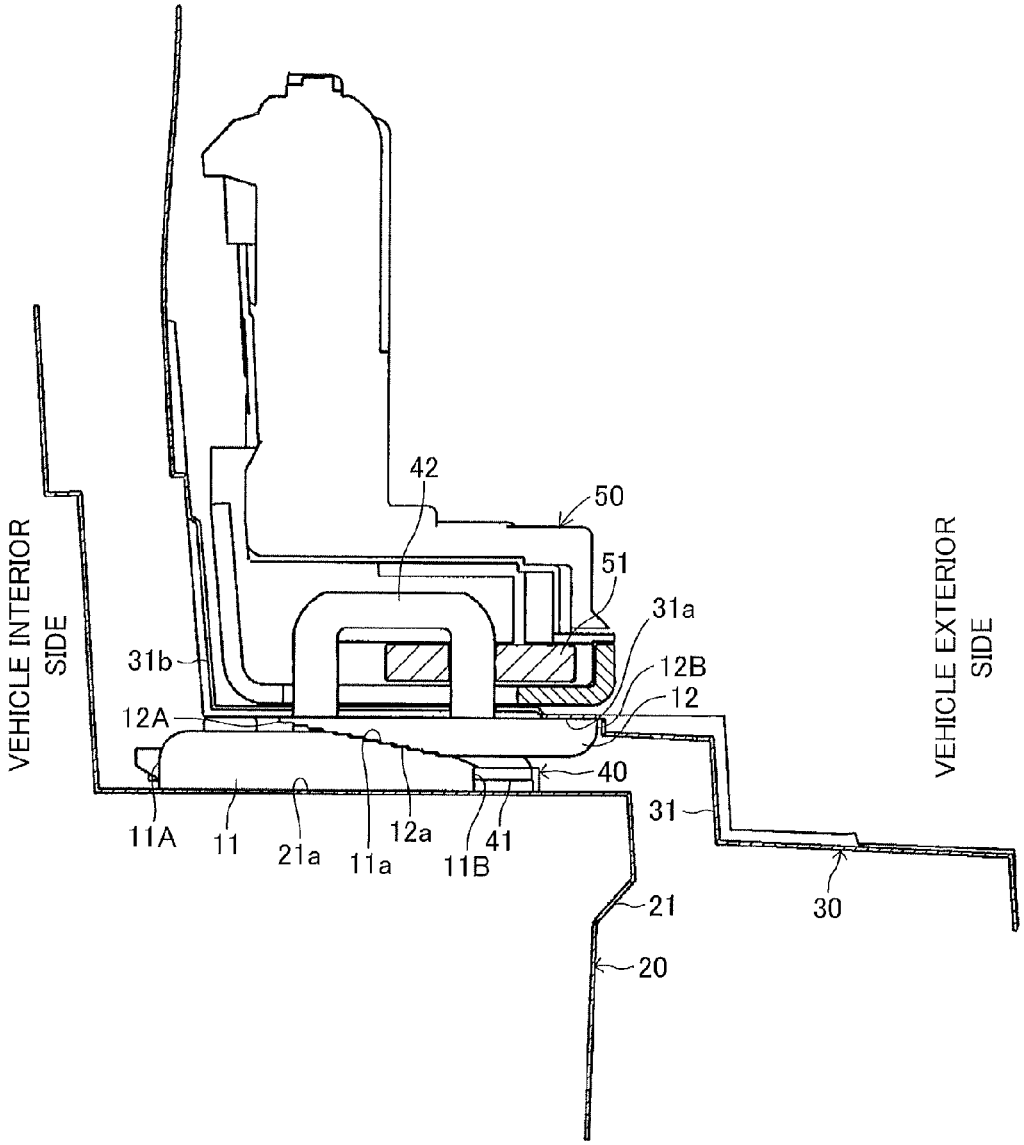
FIG. 1 is a sectional plan view of a retaining device for a vehicle door according to an embodiment of the present invention (in a state of being assembled to a side door part of a vehicle).

Hereinafter, an embodiment of the present invention is described with reference to the drawings. FIGS. 1 to 6 illustrate a retaining device for a vehicle door according to the present invention. The retaining device for a vehicle door includes a movable wedge 11 to be assembled to a vehicle body 20 together with a door lock striker 40 of a vehicle door lock device, a stationary wedge 12 to be assembled to a vehicle door 30 together with a door lock assembly 50 of the vehicle door lock device, and an elastic member 13 (see FIGS. 3 and 4) for biasing the movable wedge 11 toward the stationary wedge 12 in a retracting direction of the vehicle door 30 (right side of FIG. 1, corresponding to a door opening direction). Note that, the door lock assembly 50 includes a latch 51 which is engageable/disengageable with respect to the door lock striker 40, and the door lock assembly 50 itself is a known door lock assembly.

In the retaining device for a vehicle door, when the door is closed as illustrated in FIG. 1, an inclined surface 11*a* formed in the movable wedge 11 and an inclined surface 12*a* formed in the stationary wedge 12 are abuttable against (surface-contactable with) each other. Note that, the vehicle door 30 of this embodiment is a side door on a front and right side of a vehicle having a completely-opened vehicle body structure or a vehicle having a convertible vehicle body structure (vehicle including a roof which is openable/closable or mountable/removable). A side part opening (door opening) provided in the vehicle body 20 is openable/closable in a right-left direction of FIG. 1 (vehicle width direction).

As illustrated in FIGS. 1 to 5, the movable wedge 11 is assembled in advance to a base plate 41 of the door lock striker 40 of the vehicle door lock device together with the elastic member 13. The movable wedge 11 is assembled to an end surface 21*a* of the vehicle body 20 on the vehicle body opening side together with the base plate 41 of the door lock striker 40, which is assembled to the vehicle body 20 with use of two bolts (not shown). Note that, the end surface 21*a* of the vehicle body 20 on the vehicle body opening side is an end surface in a front-rear direction (rear end surface) formed in a constituent member (side member outer panel) 21 of the side part opening (door opening) of the vehicle body 20.

Figure 4:
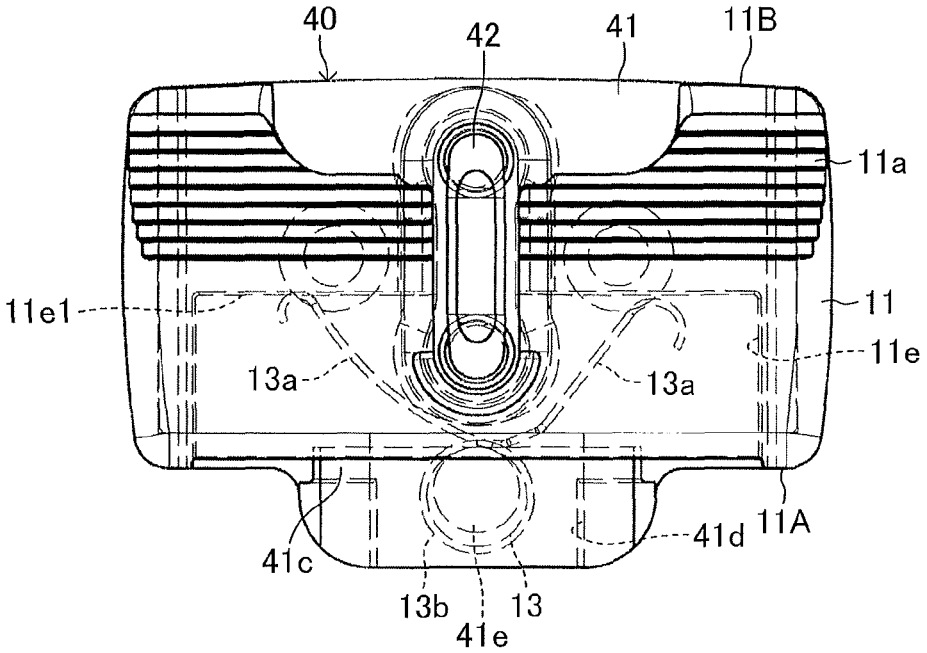
FIG. 4 is a transparent view of an elastic member covered with the movable wedge in the structure illustrated in FIG. 2.
Figure 5:
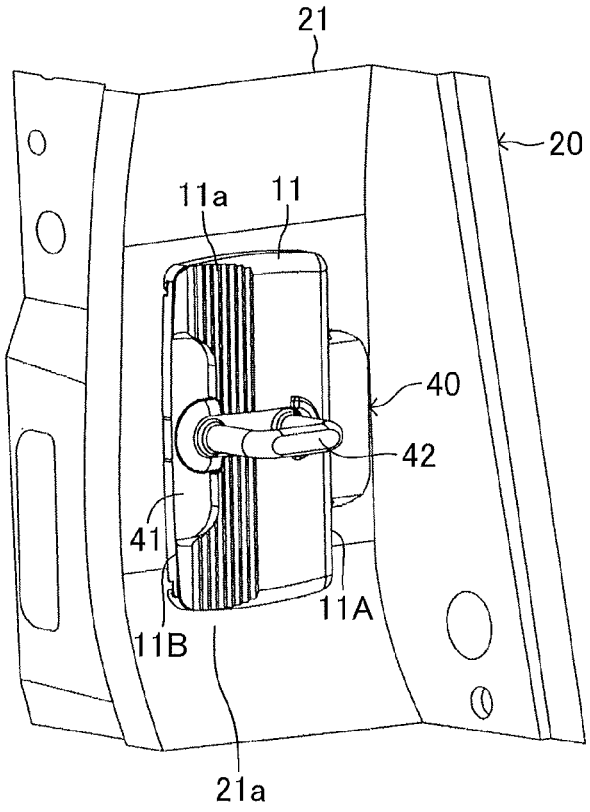
FIG. 5 is a perspective view of a state in which the structure illustrated in FIG. 2 is assembled to an end surface of an opening part in a front-rear direction, the opening part being provided to a side part of a vehicle body.
Figure 10:
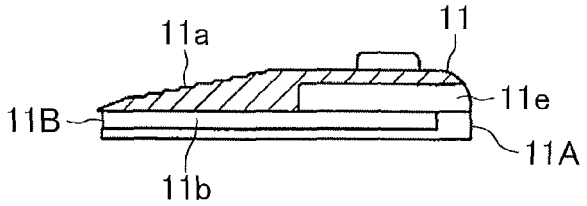
FIG. 10 is a sectional view taken along the line A2-A2 of the movable wedge illustrated in FIG. 7.
Figure 11:
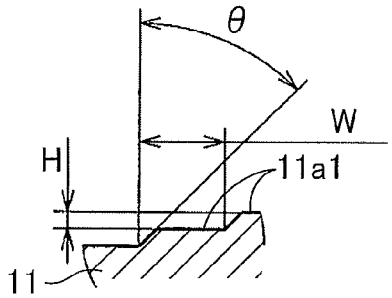
FIG. 11 is an enlarged sectional view of an inclined surface of the movable wedge illustrated in FIG. 7.

As illustrated in FIGS. 1 and 5, the movable wedge 11 has a rectangular shape having an end portion 11A on a vehicle interior side, which faces the vehicle interior side, and an end portion 11B on a vehicle exterior side, which faces the vehicle exterior side. Further, as illustrated in FIGS. 7 to 11, the movable wedge 11 includes, in addition to the inclined surface 11*a*, a pair of guide grooves 11*b*, a slit 11*c*, a pair of cutouts 11*d*, and a concave portion 11*e*. As illustrated in FIGS. 1 to 5, the movable wedge 11 is slidably supported by the base plate 41 of the door lock striker 40. As illustrated in FIG. 1, the inclined surface 11*a* is formed in the movable wedge 11 on a side opposed to the stationary wedge 12 from substantially the center thereof in the vehicle width direction toward the end portion 11B on the vehicle exterior side. The inclined surface 11*a* is provided with a large number of stepped portions 11*a*1 having a shape illustrated in an enlarged manner in FIG. 11. The respective stepped portions 11*a*1 are formed into the same shape in cross section, and as illustrated in FIG. 11, have a width (length in the vehicle width direction) W, a height H, and an end portion inclination angle θ.

Figure 2:
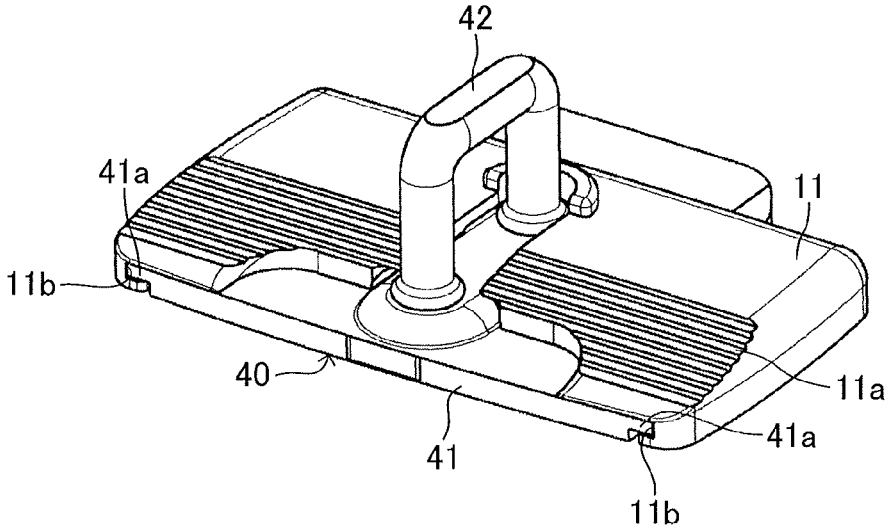
FIG. 2 is a perspective view of a state in which a movable wedge of the retaining device for a vehicle door illustrated in FIG. 1 is assembled to a door lock striker of a vehicle door lock device.
Figure 8:
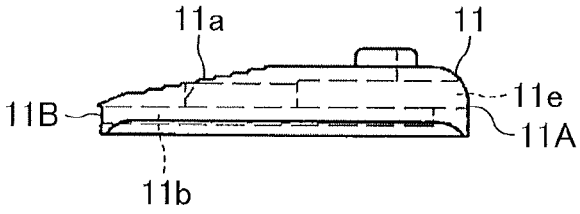
FIG. 8 is a bottom view of the movable wedge illustrated in FIG. 7.
Figure 9:
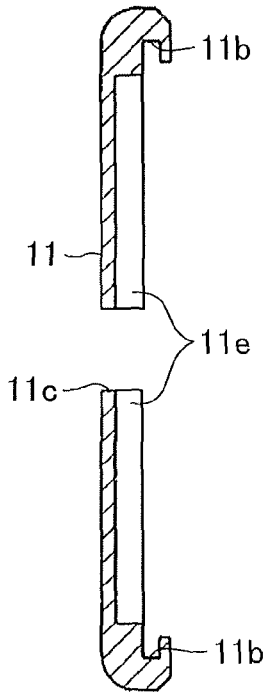
FIG. 9 is a sectional view taken along the line A1-A1 of the movable wedge illustrated in FIG. 7.

The pair of guide grooves 11*b* enables the movable wedge 11 to be move (slide) along the base plate 41 in the vehicle width direction, and is formed so as to be opposed to each other at both longitudinal end portions (both upper and lower end portions in FIGS. 7 and 9) of the movable wedge 11. As illustrated in FIG. 2, the pair of guide grooves 11*b* is slidably assembled to guide rails 41*a* formed in the base plate 41. Note that, as illustrated in FIGS. 8 and 10, each of the guide grooves 11*b* has an opened left end and a closed right end.

Figure 15:
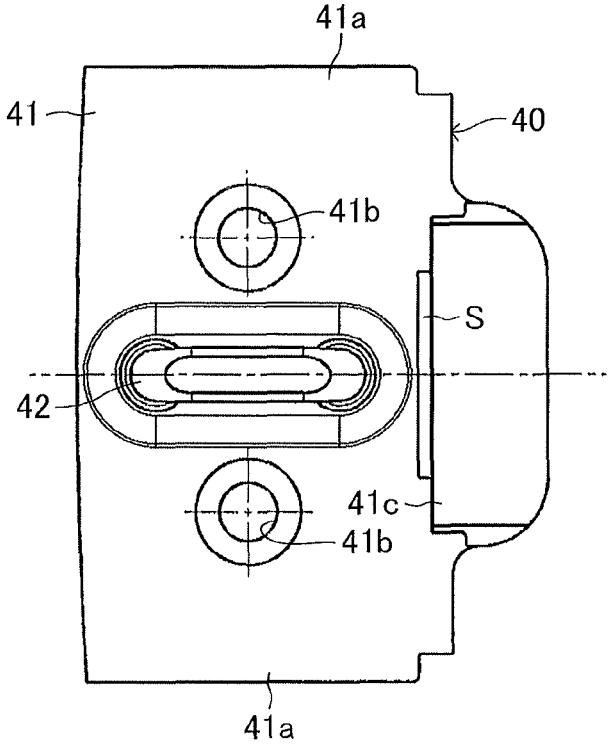
FIG. 15 is a front view of the door lock striker illustrated in FIGS. 1 to 5.

The slit 11*c* is arranged above a surface of the base plate 41 on which a shaft 42 of the door lock striker 40 is provided upright, and enables the movable wedge 11 to move in the vehicle width direction relative to the shaft 42 of the door lock striker 40 (allows the movement of the movable wedge 11 relative to the shaft 42). The slit 11*c* is formed into a linear shape at a longitudinal center of the movable wedge 11 along the vehicle width direction. The pair of cutouts 11*d* is formed on both sides of an end portion of the slit 11*c* on the opening side, and enables bolts to be inserted into bolt insertion holes 41*b* (for example, see FIG. 15), which are formed in the base plate 41 of the door lock striker 40, in a state in which the movable wedge 11 has moved against the elastic member 13. The concave portion 11*e* is formed in the movable wedge 11 on a rear surface side thereof (on a side of the end portion 11A on the vehicle interior side). As illustrated in FIG. 4, the concave portion 11*e* can house both arm portions 13*a* of the elastic member 13. When an end surface 11*e*1 to be engaged with leading ends of both the arm portions 13*a* abuts against a leading end of a projection 41*c* provided in the base plate 41, the concave portion 11*e* functions as a stopper for restricting the movement of the movable wedge 11 against the elastic member 13.

Figure 6:
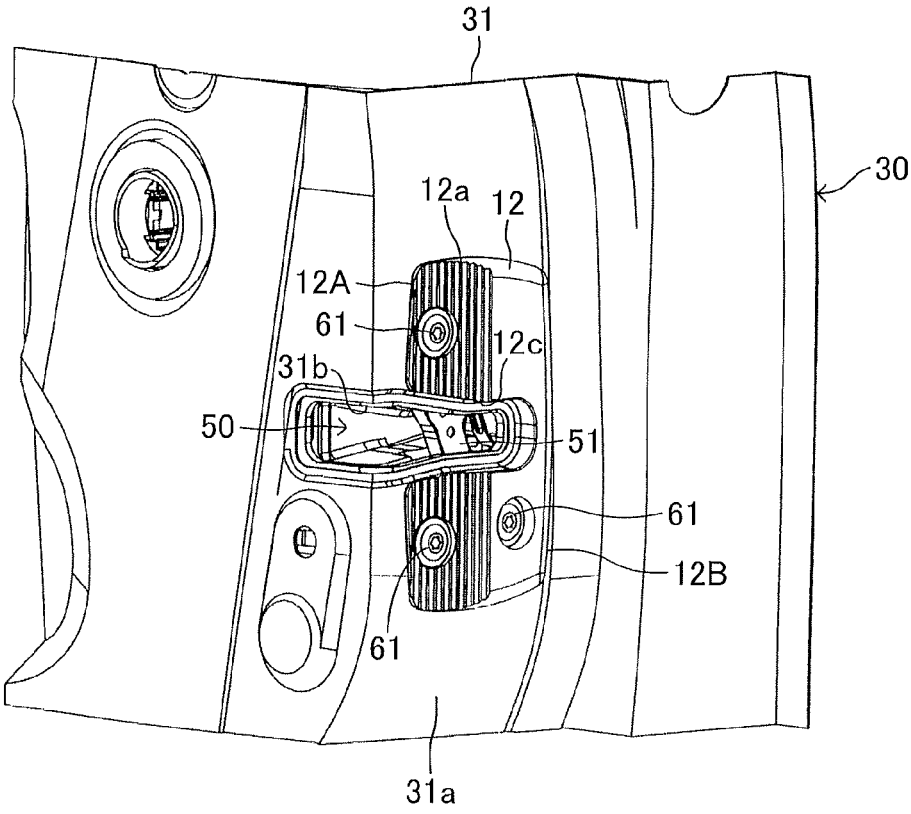
FIG. 6 is a perspective view of a state in which a stationary wedge of the retaining device for a vehicle door illustrated in FIG. 1 is assembled to an end surface of the vehicle door (side door) in the front-rear direction.
Figure 7:
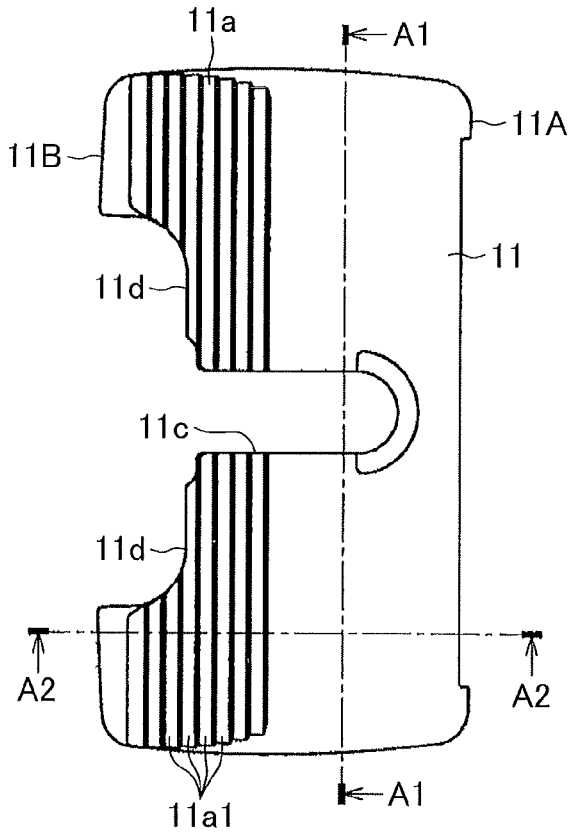
FIG. 7 is a front view of the movable wedge illustrated in FIGS. 1 to 5.

The stationary wedge 12 is not assembled in advance to the door lock assembly 50 of the vehicle door lock device. As illustrated in FIGS. 1 and 6, the stationary wedge 12 is fastened together with the door lock assembly 50 when the door lock assembly 50 is assembled to a constituent member (door inner panel) 31 of the vehicle door 30 with use of three bolts 61 so that the stationary wedge 12 is assembled to the end surface 31*a* on the vehicle door side in an unmovable state. Note that, the end surface 31*a* on the vehicle door side comes close to the end surface 21*a* on the vehicle body opening side when the door is closed, and corresponds to the end surface in the front-rear direction (rear end surface) formed in the door inner panel 31 of the vehicle door 30 which enables opening/closing of the side part opening (door opening) of the vehicle body 20.

Figure 12:
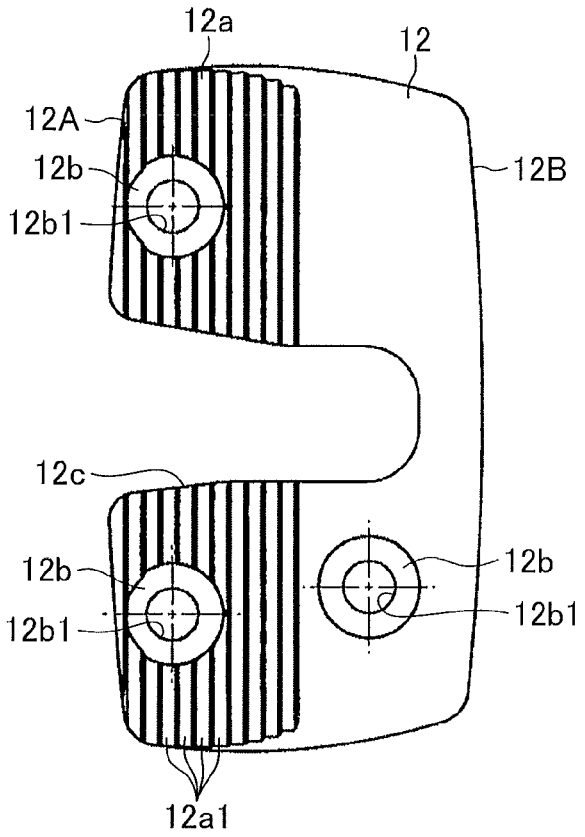
FIG. 12 is a front view of the stationary wedge illustrated in FIGS. 1 and 6.
Figure 13:
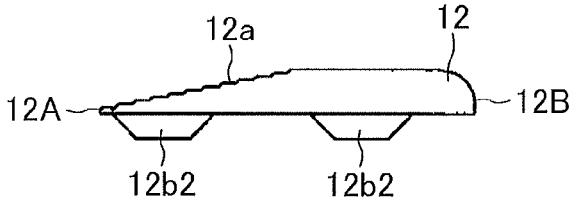
FIG. 13 is a bottom view of the stationary wedge illustrated in FIG. 12.
Figure 14:
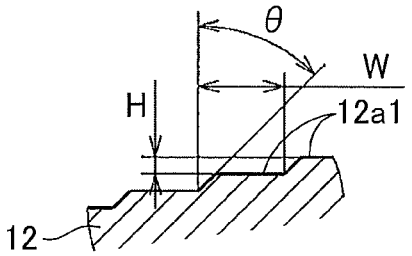
FIG. 14 is an enlarged sectional view of an inclined surface of the stationary wedge illustrated in FIG. 12.

As illustrated in FIGS. 1 and 6, the stationary wedge 12 has a rectangular shape including an end portion 12A on the vehicle interior side, which faces the vehicle interior side, and an end portion 12B on the vehicle exterior side, which faces the vehicle exterior side. Further, as illustrated in FIGS. 12 to 14, the stationary wedge 12 includes, in addition to the inclined surface 12*a*, three fixing portions 12*b* and a slit 12*c*. As illustrated in FIG. 1, the inclined surface 12*a* is formed in the stationary wedge 12 in an end part on the vehicle interior side and on a side opposed to the movable wedge 11 from substantially the center thereof in the vehicle width direction toward the end portion 12A on the vehicle interior side. The inclined surface 12*a* is provided with a large number of stepped portions 12*a*1 having a shape illustrated in an enlarged manner in FIG. 14. The respective stepped portions 12*a*1 are formed into the same shape in cross section, and as illustrated in FIG. 14, have a width (length in the vehicle width direction) W, a height H, and an end portion inclination angle θ. Further, the respective stepped portions 12*a*1 have the same shape as the respective stepped portions 11*a*1 of the movable wedge 11. Therefore, the respective stepped portions 12*a*1 of the stationary wedge 12 are engageable (meshable) with the respective stepped portions 11*a*1 of the movable wedge 11.

Each of the fixing portions 12*b* has an insertion hole 12*b*1 through which a shaft portion of the above-mentioned bolt 61 is inserted, and a tapered portion 12*b*2 (see FIG. 13). The tapered portion 12*b*2 is inserted through a fixing hole (not shown) provided in the door inner panel 31 when the stationary wedge 12 is assembled to the door inner panel 31. The tapered portion 12*b*2 is formed on a rear portion of the stationary wedge 12 in a projecting manner.

As illustrated in FIG. 6, the slit 12*c* is formed into a shape which matches with a shape of a part of a door lock striker entering/exiting hole 31*b* formed in the door inner panel 31, which extends in the vehicle width direction (shape which enables the shaft 42 of the door lock striker 40 to relatively enter/exit). The slit 12*c* extends in the vehicle width direction at a longitudinal center of the stationary wedge 12. Note that, as illustrated in FIG. 12, the slit 12*c* has an opened left end and a closed right end. Further, the stationary wedge 12 is arranged around the door lock striker entering/exiting hole 31*b*.

Figure 3:
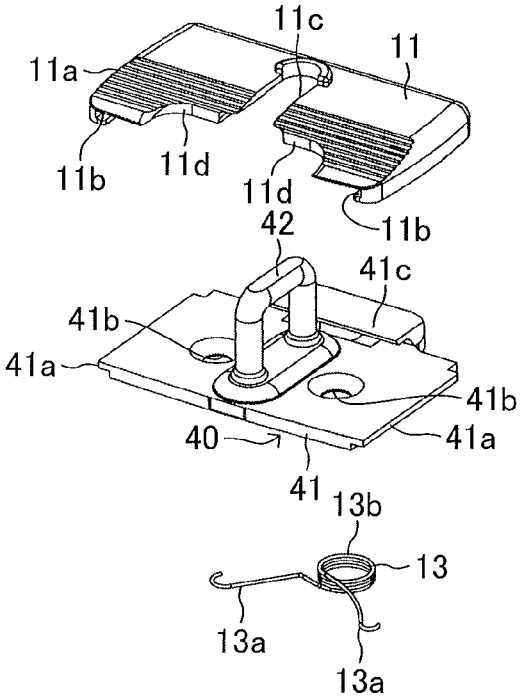
FIG. 3 is an exploded perspective view of the structure illustrated in FIG. 2.

As illustrated in FIGS. 3 and 4, the elastic member 13 includes the pair of arm portions 13*a* and a coil portion 13*b*. The pair of arm portions 13*a* is housed in the concave portion 11*e* of the movable wedge 11, and has leading ends which slidably engage with the end surface 11*e* of the concave portion 11*e*. The coil portion 13*b* is provided between both the arm portions 13*a*, and is assembled to the base plate 41 of the door lock striker 40.

As illustrated in FIGS. 1 to 5 and 15 to 20, the door lock striker 40 includes the base plate 41, which is to be assembled to the side member outer panel 21 of the vehicle body 20 with use of a bolt (now shown), and the C-shaped shaft 42, which is integrally fixed to and provided upright from the base plate 41. The door lock striker 40 is a known door lock striker except for the shape of the base plate 41. The base plate 41 includes, in addition to the above-mentioned guide rails 41*a*, bolt insertion holes 41*b*, and projection 41*c*, a concave portion 41*d* and a pin portion 41*e*.

The concave portion 41*d* is formed in the projection 41*c* on the rear surface side by a predetermined depth D (see FIG. 16), and has a slit S formed therein, which passes through the base plate 41 toward the front surface thereof. The concave portion 41*d* can house the coil portion 13*b* of the elastic member 13, and both the arm portions 13*a* of the elastic member 13 pass through the slit S to be exposed to the outer side (front surface side) of the base plate 41. As illustrated in FIG. 4, the part of the elastic member 13 (both arm portions 13*a*) exposed to the outer side (front surface side) of the base plate 41 is covered with the movable wedge 11, and hence is not exposed to the outside.

Figure 16:
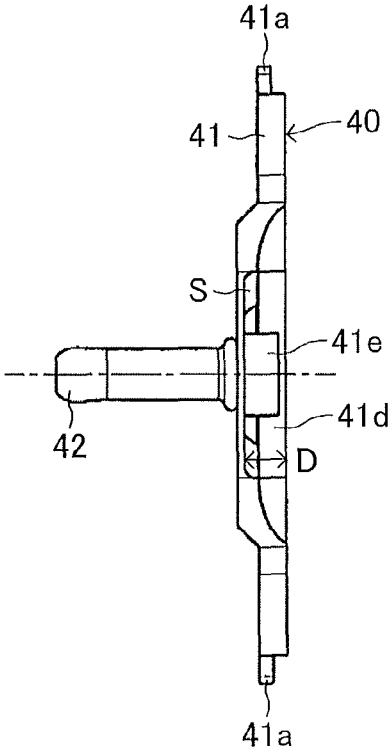
FIG. 16 is a right side view of the door lock striker illustrated in FIG. 15.
Figure 17:
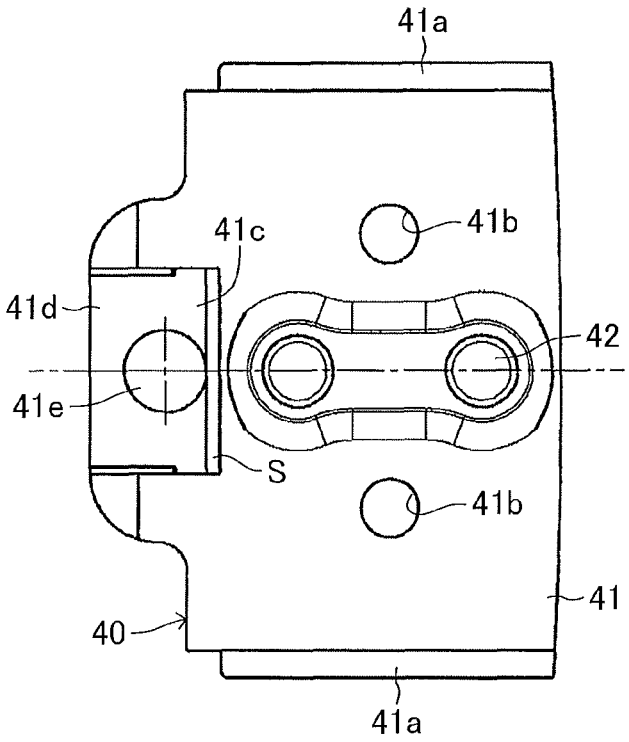
FIG. 17 is a rear view of the door lock striker illustrated in FIG. 15.
Figure 18:
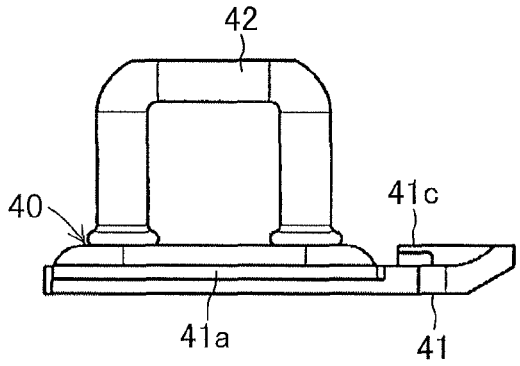
FIG. 18 is a bottom view of the door lock striker illustrated in FIG. 15.
Figure 19:
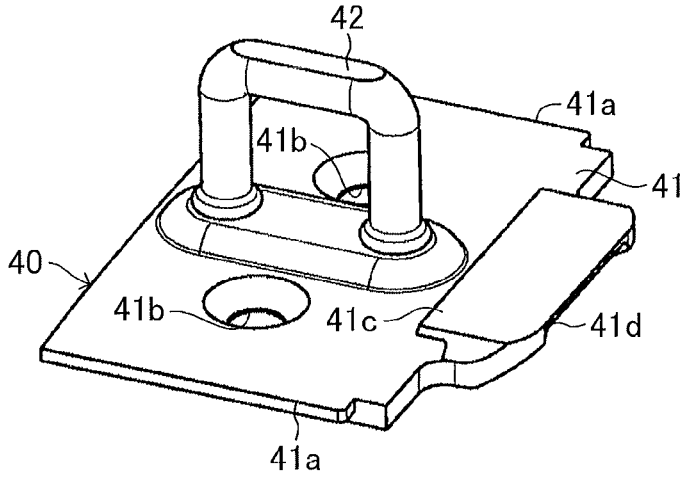
FIG. 19 is a perspective view of the door lock striker illustrated in FIG. 15 when viewed from the front side.
Figure 20:
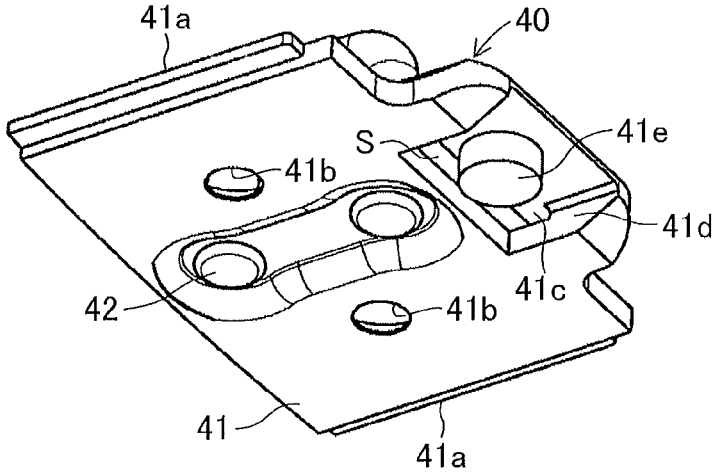
FIG. 20 is a perspective view of the door lock striker illustrated in FIG. 15 when viewed from the rear side.

As illustrated in FIGS. 16, 17, and 20, the pin portion 41*e* is provided in the concave portion 41*d*, and projects toward the rear surface of the base plate 41 by a predetermined amount. As illustrated in FIG. 4, the pin portion 41*e* is formed to have a diameter smaller than that of the coil portion 13*b* of the elastic member 13, and can support the coil portion 13*b* of the elastic member 13.

In the retaining device for a vehicle door according to the embodiment configured as described above, when the retaining device is assembled to the vehicle, the man-hours for assembling the door lock striker 40 to the end surface 21*a* on the vehicle body opening side and the man-hours for assembling the door lock assembly 50 to the end surface 31*a* on the vehicle door side can be efficiently used. Therefore, compared to the case where the retaining device is assembled to the vehicle separately from the door lock striker and the door lock assembly, the assembly man-hours can be reduced to improve the assembly workability. Further, the retaining device can be set to the vehicle at low cost.

Further, in this embodiment, both the arm portions 13*a* (part which passes through the slit S of the base plate 41 to be exposed to the outer side of the base plate 41) of the elastic member 13 are covered with the movable wedge 11 and are not exposed to the outside. Note that, the coil portion 13*b* of the elastic member 13 is housed in the concave portion 41*d* of the base plate 41, and is not exposed to the outside. Therefore, even when the vehicle door 30 is in an opened state, the elastic member 13 is not exposed to the outside, which improves the physical appearance of the vehicle. In addition, it is possible to prevent foreign matters from entering the elastic member 13 and protect the elastic member 13.

Further, in this embodiment, the inclined surface 11*a* of the movable wedge 11 and the inclined surface 12*a* of the stationary wedge 12 are each provided with the large number of stepped portions 11*a*1 and 12*a*1 which are engageable with each other. Therefore, without setting the inclination angle of each of the inclined surfaces 11*a* and 12*a* to an angle of friction or lower, the slipping between the inclined surface 11*a* of the movable wedge 11 and the inclined surface 12*a* of the stationary wedge 12 can be prevented, and the inclined surfaces 11*a* and 12*a* can be downsized (formed in a limited space).

Figure 21:
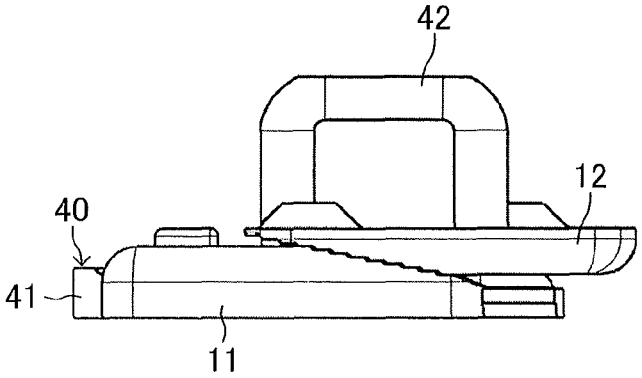
FIG. 21 is an operation explanatory view of a state in which, in the retaining device for a vehicle door illustrated in FIG. 1, the movable wedge has moved by a predetermined amount against a biasing force of the elastic member.
Figure 22:
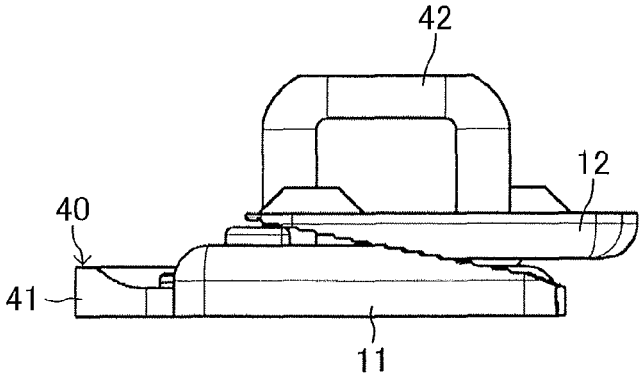
FIG. 22 is an operation explanatory view of a state in which the movable wedge illustrated in FIG. 21 has moved by a predetermined amount by the biasing force of the elastic member.

Further, in this embodiment, the end surface 21*a* on the vehicle body opening side is the end surface in the front-rear direction (rear end surface) of the opening part provided in the side part of the vehicle body 20, and the end surface 31*a* on the vehicle door side is the end surface in the front-rear direction (rear end surface) of the vehicle door (side door) 30 which enables opening/closing of the opening part. Therefore, when bending deformation in the right-left direction occurs in the vehicle body 20 at the time of turning of the vehicle and the like, on the extending side of the vehicle body 20, for example, the movable wedge 11 in a state illustrated in FIG. 21 may move relative to the stationary wedge 12 to the right side of FIG. 21 to reach the state illustrated in FIG. 22 so as to move the stationary wedge 12 to the upper side of FIGS. 21 and 22 (vehicle front-rear direction). In this manner, a gap generated between the opening part of the vehicle body 20 and the vehicle door (side door) 30 in the vehicle front-rear direction can be closed (filled). Therefore, at the time of turning of the vehicle and the like in which the side on which the movable wedge 11 has moved relative to the stationary wedge 12 is the contraction side of the vehicle body 20, the deformation of the vehicle body 20 on the contraction side is suppressed by the movable wedge 11 and the stationary wedge 12. Therefore, with the retaining device for a vehicle door, the rigidity of the vehicle body of the vehicle can be effectively increased.

The above-mentioned embodiment is carried out by forming the inclined surface 11*a* of the movable wedge 11 and the inclined surface 12*a* of the stationary wedge 12 so that the large number of stepped portions 11*a*1 and 12*a*1, which are engageable with each other, have the same shape (shape which has the width W, the height H, and the end portion inclination angle θ, and in which a flat surface in the width W is parallel to the rear surface of the movable wedge 11 and the rear surface of the stationary wedge 12). However, the shapes of the respective stepped portions 11*a*1 and 12*a*1 can be changed as appropriate. Further, the present invention can be carried out without forming the respective stepped portions 11*a*1 and 12*a*1. When the present invention is carried out without forming the respective stepped portions 11*a*1 and 12*a*1, it is desired that the inclination angle of each of the inclined surface of the movable wedge (11) and the inclined surface of the stationary wedge (12) be the angle of friction or lower.

Further, in the above-mentioned embodiment, description is made of an embodiment in which the vehicle door 30 is a side door of a vehicle having a completely-opened vehicle body structure or a vehicle having a convertible vehicle body structure (vehicle including a roof which is openable/closable or mountable/removable). However, the vehicle door of the present invention is only required to be an opening/closing door which enables opening/closing of the opening part of the vehicle body. There may be employed, in addition to a side door of a vehicle including an unopenable or unremovable roof, a slide-type side door which slides in the front-rear direction of the vehicle to open/close the side part opening of the vehicle body, or a back door (rear gate) which is vertically or laterally tiltable to open/close a rear part opening of the vehicle body.

Further, the above-mentioned embodiment is carried out by assembling the movable wedge 11 to the base plate 41 of the door lock striker 40 to be assembled to the vehicle body 20 (to the end surface on the vehicle body opening side), and assembling the stationary wedge 12 to the constituent member (door inner panel) 31 of the vehicle door 30 (to the end surface on the vehicle door side), together with the door lock assembly 50 to be assembled to the vehicle door 30. However, the present invention can be carried out by assembling the stationary wedge to the base plate of the door lock striker (to the end surface on the vehicle body opening side), and assembling the movable wedge to the constituent member of the vehicle door (to the end surface on the vehicle door side). Note that, as a material for the stationary wedge 12 (or the movable wedge) to be assembled to the vehicle door 30, a reflecting material can be employed, or alternatively, for example, a reflecting plate may be provided to the stationary wedge 12 (or the movable wedge) in a part other than the inclined surface, to thereby cause the stationary wedge 12 (or the movable wedge) to function as a reflecting plate.

Further, the above-mentioned embodiment is carried out by assembling, together with the door lock assembly 50 to be assembled to the vehicle door 30, the stationary wedge 12 to the constituent member (door inner panel) 31 of the vehicle door 30 (to the end surface on the vehicle door side) (specifically, the stationary wedge 12 is fastened together with the door lock assembly 50 when the door lock assembly 50 is assembled to the constituent member (door inner panel) 31 of the vehicle door 30 with use of the three bolts 61 so that the stationary wedge 12 is assembled to the end surface 31*a* on the vehicle door side). However, it is only required that the stationary wedge (or the movable wedge) to be assembled to the end surface on the vehicle door side be assembled to a fixing portion of the end surface on the vehicle door side, which is provided for the door lock assembly to be assembled to the end surface on the vehicle door side. Therefore, the stationary wedge (or the movable wedge) is not necessarily assembled to the fixing portion of the end surface on the vehicle door side together with the door lock assembly.

Figure 23:
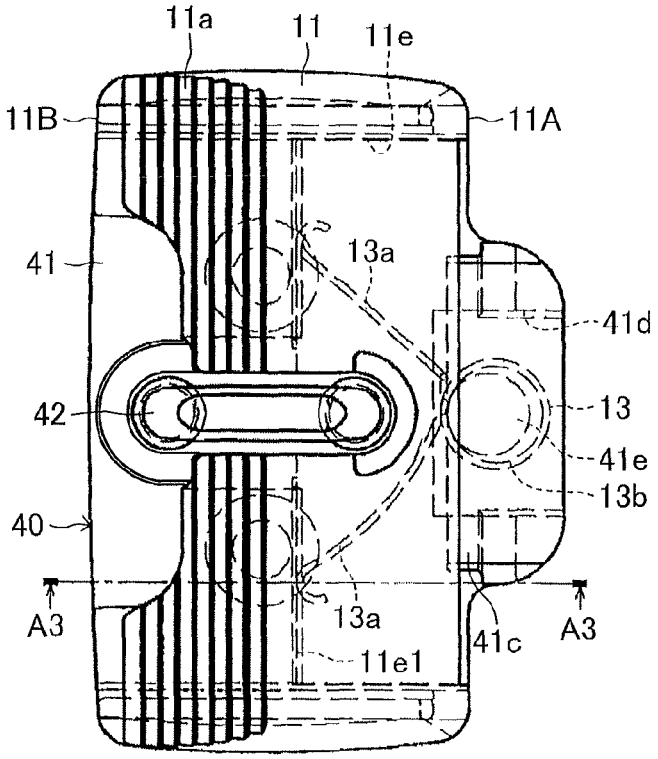
FIG. 23 is a view illustrating the movable wedge and the elastic member according to a modified embodiment of the present invention, which corresponds to FIG. 4.
Figure 24:
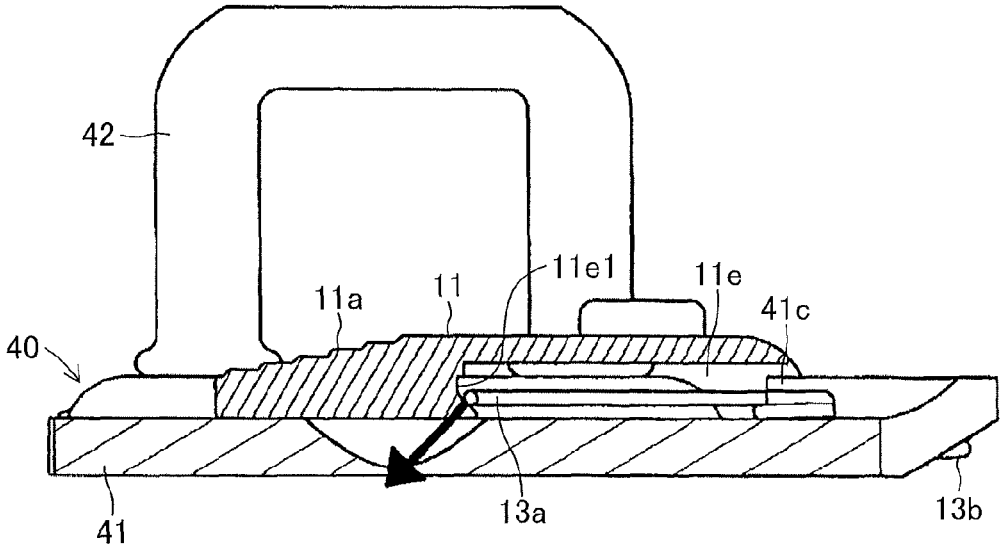
FIG. 24 is an enlarged sectional view taken along the line A3-A3 of FIG. 23.

FIGS. 23 and 24 illustrate the movable wedge 11 and the elastic member 13 according to a modified embodiment of the present invention. In this embodiment, a part (lower part in FIG. 24) of the end surface 11*e* of the movable wedge 11, which engages with the leading ends of the respective arm portions 13*a* of the elastic member 13, is formed into an inclined shape as illustrated in FIG. 24. Therefore, the elastic member 13 also biases the movable wedge 11 toward an upper surface (end surface on a side to which the movable wedge 11 is to be assembled) of the base plate 41 as indicated by the arrow of FIG. 24. Thus, the movable wedge 11 slidably abuts against the upper surface of the base plate 41 in the entering/retracting direction of the vehicle door 30 (right-left direction in FIG. 24). Therefore, in this embodiment, when the vehicle door 30 is opened/closed, the unnecessary movement (backlash) of the movable wedge 11 with respect to the base plate 41 is restricted. Therefore, generation of abnormal noise (rattling) caused by the unnecessary movement of the movable wedge 11 can be suppressed.

In the respective embodiments described above, description is made of an embodiment in which the stationary wedge 12 is assembled to the constituent member (door inner panel 31) of the vehicle door (to the end surface on the vehicle door side) or to the base plate of the door lock striker (to the end surface on the vehicle body opening side). However, as in respective embodiments illustrated in FIGS. 25 and 26, it is also possible to integrally provide (integrally form) the stationary wedge 12 in a part of the door inner panel 31 of the vehicle door 30 (fixing portion of the end surface on the vehicle door side, to which the door lock assembly is to be assembled). Alternatively, as illustrated in FIGS. 27 and 28 or FIGS. 29 and 30, it is also possible to integrally provide (integrally form) the stationary wedge 12 in the base plate 41 of the door lock striker 40 to be assembled to the end surface on the vehicle body opening side. In those cases, the assembly man-hours for the stationary wedge 12 of the retaining device are unnecessary, and hence the assembly workability of the retaining device can be further improved.

Figure 25:
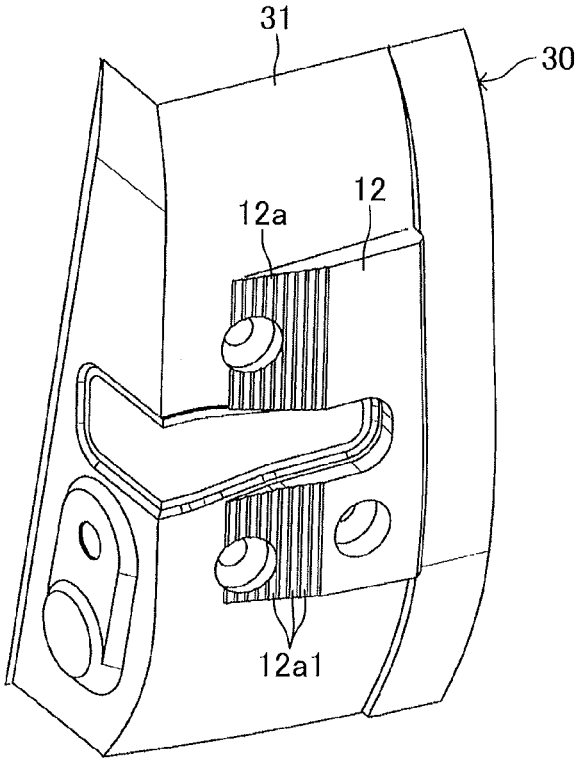
FIG. 25 is a perspective view of a retaining device for a vehicle door according to an embodiment of the present invention, in which the stationary wedge (with a large number of stepped portions) is integrally provided to the end surface of the vehicle door (side door) in the front-rear direction.
Figure 26:
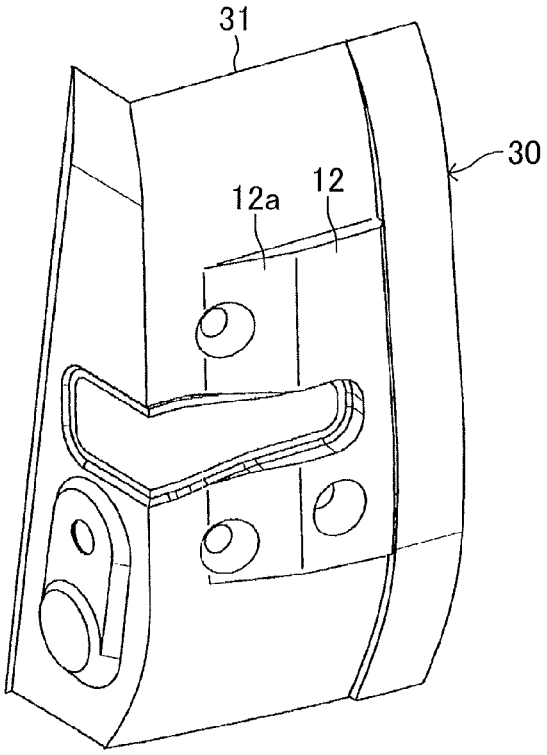
FIG. 26 is a perspective view of a retaining device for a vehicle door according to an embodiment of the present invention, in which the stationary wedge (without a large number of stepped portions) is integrally provided to the end surface of the vehicle door (side door) in the front-rear direction.
Figure 27:
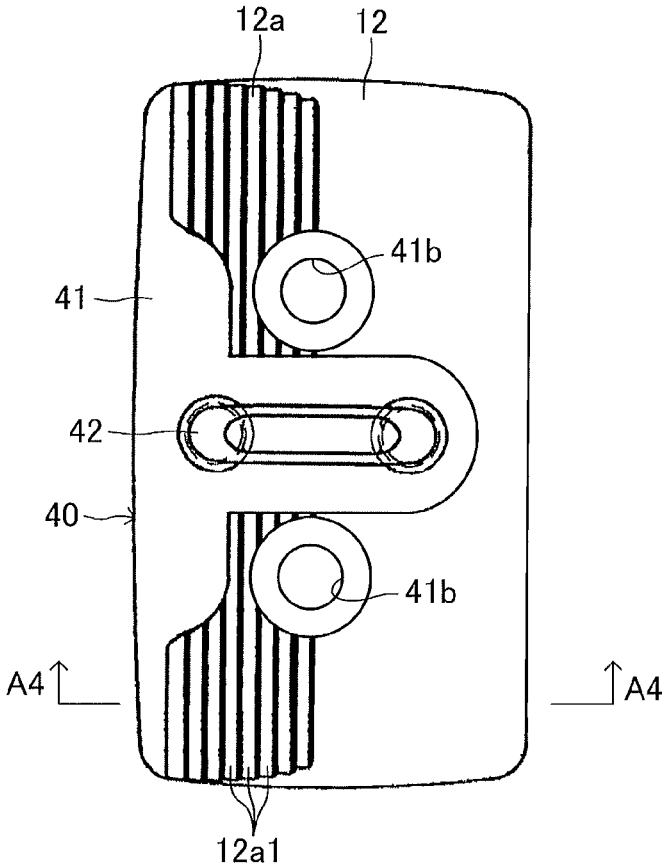
FIG. 27 is a front view of a retaining device for a vehicle door according to an embodiment of the present invention, in which the stationary wedge (with a large number of stepped portions) is integrally provided to a base plate of the door lock striker.
Figure 28:
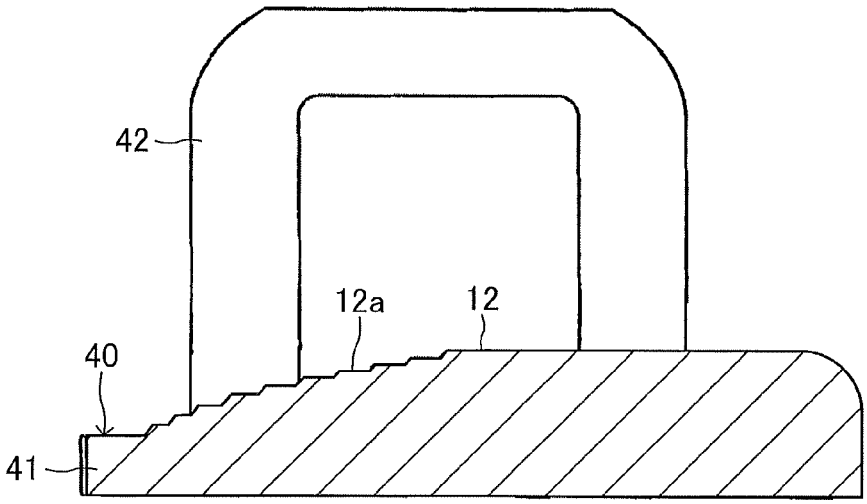
FIG. 28 is an enlarged sectional view taken along the line A4-A4 of FIG. 27.
Figure 29:
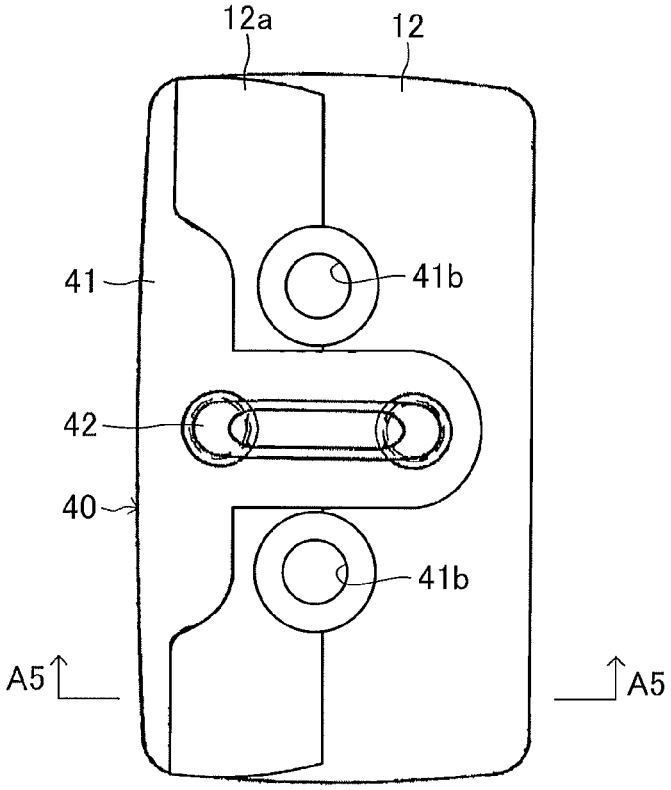
FIG. 29 is a front view of a retaining device for a vehicle door according to an embodiment of the present invention, in which the stationary wedge (without a large number of stepped portions) is integrally provided to the base plate of the door lock striker.
Figure 30:
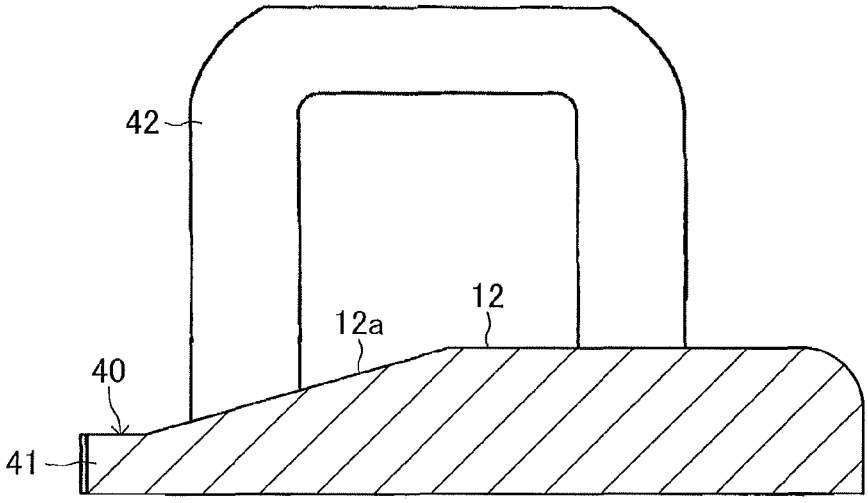
FIG. 30 is an enlarged sectional view taken along the line A5-A5 of FIG. 29.

Note that, the door inner panel 31 according to each embodiment illustrated in FIG. 25 or 26 has a rear surface to which a reinforcing plate called a lock reinforcement is fixed, and the strength of the door inner panel itself is increased sufficiently. Further, in the base plate 41 according to each embodiment illustrated in FIGS. 27 and 28 or FIGS. 29 and 30, the thickness of the base plate itself is sufficient, and thus the strength of the base plate itself is increased sufficiently. Further, in the embodiment illustrated in FIG. 25 and the embodiment illustrated in FIGS. 27 and 28, the large number of stepped portions 12*a*1 are formed in the inclined surface 12*a* of the stationary wedge 12, while in the embodiment illustrated in FIG. 26 and the embodiment illustrated in FIGS. 29 and 30, the large number of stepped portions 12*a*1 are not formed in the inclined surface 12*a* of the stationary wedge 12.

The invention claimed is:

1. A retaining device for a vehicle door, comprising:

a movable wedge which is adapted to be assembled to an end surface on a vehicle body opening side, wherein the end surface on the vehicle body opening side and an end surface on the vehicle door side come close to each other when the vehicle door is closed, the movable wedge being movable in an opening/closing direction of the vehicle door toward the vehicle body opening, the movable wedge having an inclined surface;

a stationary wedge which is adapted to be immovably assembled to the end surface on the vehicle door side, the stationary wedge having an inclined surface; and an elastic member for biasing the movable wedge toward the stationary wedge, the inclined surface formed in the movable wedge and the inclined surface formed in the stationary wedge being abuttable against each other when the vehicle door is closed, wherein the movable wedge is adapted to be assembled to the end surface on the vehicle body opening side together with a base plate of a door lock striker to be assembled to the end surface on the vehicle body opening side, wherein the stationary wedge is adapted to be assembled to a fixing portion of the end surface on the vehicle door side, the fixing portion being provided for a door lock assembly to be assembled to the end surface on the vehicle door side, wherein the base plate is adapted to be assembled to the end surface on the vehicle body by fasteners which are covered by the movable wedge when the movable wedge is in its original position, and wherein, when the vehicle door is open, the movable wedge is in its original position and the movable wedge, which is in its original position, completely covers the fasteners.

2. A retaining device for a vehicle door according to claim 1, wherein the stationary wedge to be assembled to the end surface on the vehicle door side is arranged around a door lock striker entering/exiting hole provided in the end surface on the vehicle door side.

3. A retaining device for a vehicle door according to claim 1, wherein the stationary wedge to be assembled to the end surface on the vehicle door side is assembled to the end surface on the vehicle door side together with the door lock assembly to be assembled to the end surface on the vehicle door side.

4. A retaining device for a vehicle door according to claim 1, wherein the movable wedge to be assembled to the end surface on the vehicle body opening side comprises a slit to be arranged above a surface of the base plate on which a shaft of the door lock striker is provided upright, for allowing movement of the movable wedge relative to the shaft, the movable wedge being slidably supported by the base plate.

5. A retaining device for a vehicle door, comprising:

a movable wedge which is adapted to be assembled to an end surface on a vehicle body opening side, wherein the end surface on the vehicle body opening side and an end surface on the vehicle door side come close to each other when the vehicle door is closed, the movable wedge being movable in an opening/closing direction of the vehicle door toward the vehicle body opening, the movable wedge having an inclined surface;

a stationary wedge which is adapted to be immovably provided to the end surface on the vehicle door side, the stationary wedge having an inclined surface; and an elastic member for biasing the movable wedge toward the stationary wedge, the inclined surface formed in the movable wedge and the inclined surface formed in the stationary wedge being abuttable against each other when the vehicle door is closed, wherein the movable wedge is adapted to be assembled to the end surface on the vehicle body opening side together with a base plate of a door lock striker to be assembled to the end surface on the vehicle body opening side, wherein the stationary wedge is adapted to be provided integrally in a fixing portion of the end surface on the vehicle door side, to which a door lock assembly including a latch which is engageable/disengageable with respect to the door lock striker is to be assembled, wherein the base plate is adapted to be assembled to the end surface on the vehicle body by fasteners which are covered by the movable wedge when the movable wedge is in its original position, and wherein, when the vehicle door is open, the movable wedge is in its original position and the movable wedge, which is in its original position, completely covers the fasteners.

6. A retaining device for a vehicle door according to claim 1, wherein the elastic member is covered with the movable wedge and is not exposed to outside the vehicle body.

7. A retaining device for a vehicle door according to claim 1, wherein the elastic member also biases the movable wedge toward an end surface of the base plate on a side to which the movable wedge is to be assembled, and wherein the movable wedge slidably abuts against the end surface on the side to which the movable wedge is to be assembled in the entering/retracting direction of the vehicle door.

8. A retaining device for a vehicle door according to claim 1, wherein the inclined surface of the movable wedge and the inclined surface of the stationary wedge are each provided with a large number of stepped portions which are engageable with each other.

9. A retaining device for a vehicle door according to claim 1, wherein the end surface on the vehicle body opening side comprises an end surface of an opening part in a front-rear direction, the opening part being provided in a side part of the vehicle body, and wherein the end surface on the vehicle door side comprises an end surface of a side door in the front-rear direction, the side door enabling opening/closing of the opening part.

* * * * *